United States Patent [19]

Vanier et al.

[11] Patent Number: 4,695,286

[45] Date of Patent: Sep. 22, 1987

[54] HIGH MOLECULAR WEIGHT POLYCARBONATE RECEIVING LAYER USED IN THERMAL DYE TRANSFER

[75] Inventors: Noel R. Vanier, Rochester; Kin K. Lum, Webster, both of N.Y.

[73] Assignee: Eastman Kodak Company, Rochester, N.Y.

[21] Appl. No.: 910,551

[22] Filed: Sep. 23, 1986

Related U.S. Application Data

[63] Continuation-in-part of Ser. No. 813,200, Dec. 24, 1985, abandoned.

[51] Int. Cl.[4] ..... B41M 5/26

[52] U.S. Cl. ..... 8/471; 427/146; 427/256; 428/195; 428/412; 428/480; 428/913; 428/914; 430/945

[58] Field of Search ..... 428/195, 412, 913, 914, 428/207, 480, 488.1, 488.4; 8/470, 471; 430/945; 427/146, 256

[56] References Cited

U.S. PATENT DOCUMENTS 4,465,728 8/1984 Haigh et al. ..... 428/914

FOREIGN PATENT DOCUMENTS 19138 1/1985 Japan ..... 8/471

*Primary Examiner*—Bruce H. Hess

*Attorney, Agent, or Firm*—Harold E. Cole

[57] ABSTRACT

A dye-receiving element for thermal dye transfer comprises a support having thereon a dye image-receiving layer comprising a polycarbonate, such as a bisphenol A polycarbonate, having a number average molecular weight of at least about 25,000. Use of this material reduces an undesirable relief image which otherwise tends to be obtained.

13 Claims, No Drawings

HIGH MOLECULAR WEIGHT POLYCARBONATE RECEIVING LAYER USED IN THERMAL DYE TRANSFER

This is a continuation-in-part application of U.S. Ser. No. 813,200 by Vanier et al, filed Dec. 24, 1985 entitled "SUPPORT FOR DYE-RECEIVING ELEMENT USED IN THERMAL DYE TRANSFER", now abandoned.

This invention relates to dye-receiving elements used in thermal dye transfer, and more particularly to the use of a support having theron a dye image-receiving layer comprising a polycarbonate having a number average weight of at least about 25,000.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

In Japanese laid open publication number 19,138/85, an image-receiving element for thermal dye transfer printing is disclosed. The dye image-receiving layer disclosed comprises a polycarbonate containing a plasticizer. The specific polycarbonates employed have a relatively low average molecular weight.

While polycarbonate is a desirable material for a dye-image receiving layer because of its effective dye compatibility and receptivity, there is a problem with employing the specific polycarbonates disclosed in the above reference since they have been found to be quite susceptible to thermal surface deformation. This occurs because of the heating and pressure contact within the nip between the thermal print head and a rubber roller, which causes the raised/depressed pattern of the thermal print head to be embossed upon the receiving layer. Additional distortion of the receiving layer may also occur from differential heating. The rough relief image on the surface of the receiving layer results in an undesirable differential gloss and could also result in a maximum density loss in extreme cases.

It would be desirable to provide a polycarbonate dye-image receiving layer which does not have the disadvantages discussed above, and in which less permanent surface deformation occurs, producing more pleasing prints of uniform gloss free from visible relief images.

In accordance with this invention, a dye-receiving element for thermal dye transfer is provided which comprises a support having thereon a polycarbonate dye image-receiving layer, and wherein the polycarbonate has a number average molecular weight of at least about 25,000.

The term "polycarbonate" as used herein means a polyester of carbonic acid and glycol or a divalent phenol. Examples of such glycols or divalent phenols are p-xylyene glycol, 2,2-bis(4-oxyphenyl)propane, bis(4-oxyphenyl)methane, 1,1-bis(4-oxyphenyl)ethane, 1,1-bis(oxyphenyl)butane, 1,1-bis(oxyphenyl)cyclohexane, 2,2-bis(oxyphenyl)butane, etc.

In a preferred embodiment of the invention, the polycarbonate is a bisphenol A polycarbonate. In another preferred embodiment of the invention, the bisphenol A polycarbonate comprises recurring units having the formula

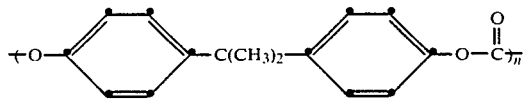

wherein n is from about 100 to about 500.

Examples of such polycarbonates include: General Electric Lexane® Polycarbonate Resin #ML-4735 (Number average molecular weight app. 36,000), and Bayer AG, Makrolon #5705® (Number average molecular weight app. 58,000).

The polycarbonate employed in the dye image-receiving layer may be present in any amount which is effective for the intended purpose. In general, good results have been obtained at a total concentration of from about 1 to about 5 $g/m^2$.

The support for the dye-receiving element of the invention may be a transparent film such as a poly(ether sulfone), a polyimide, a cellulose ester such as cellulose acetate, a poly(vinyl alcohol-coacetal) or a poly(ethylene terephthalate). The support for the dye-receiving element may also be reflective such as baryta-coated paper, white polyester (polyester with white pigment incorporated therein), an ivory paper, a condenser paper or a synthetic paper such as duPont Tyvek®. In a preferred embodiment, polyester with a white pigment incorporated therein is employed. It may be employed at any thickness desired, usually from about 50 μm to about 1000 μm.

A dye-donor element that is used with the dye-receiving element of the invention comprises a support having thereon a dye layer. Any dye can be used in such a layer provided it is transferable to the dye image-receiving layer of the dye-receiving element of the invention by the action of heat. Especially good results have been obtained with sublimable dyes. Examples of sublimable dyes include anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

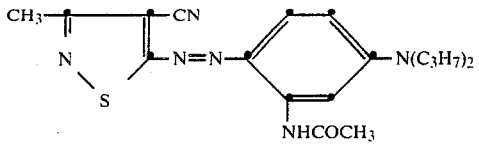

(magenta)

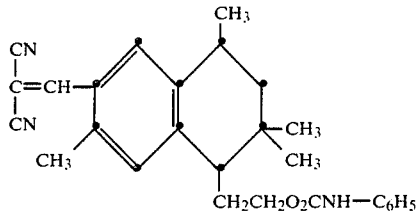

(yellow)

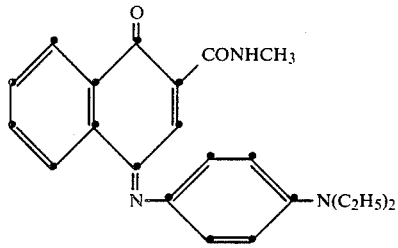

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 2 to about 30 μm. It may also be coated with a subbing layer, if desired.

A dye-barrier layer comprising a hydrophilic polymer may also be employed in the dye-donor element between its support and the dye layer which provides improved dye transfer densities. Such dye-barrier layer materials include those described and claimed in Application Ser. No. 813,294 entitled "Dye-Barrier Layer for Dye-Donor Element Used in Thermal Dye Transfer" by Vanier et al, filed Dec. 24, 1985.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

As noted above, dye-donor elements are used to form a dye transfer image. Such a process comprises image-wise-heating a dye-donor element and transferring a dye image to a dye-receiving element as described above to form the dye transfer image.

The dye-donor element employed in certain embodiments of the invention may be used in sheet form or in a continuous roll or ribbon. If a continuous roll or ribbon is employed, it may have only one dye thereon or may have alternating areas of different dyes such as cyan, magenta, yellow, black, etc., as disclosed in U.S. Pat. No. 4,541,830.

In a preferred embodiment of the invention, a dye-donor element is employed which comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements employed in the invention are available commercially. There can be employed, for example, a Fujitsu Thermal Head (FTP-040 MCSOO1), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following example is provided to illustrate the invention.

EXAMPLE

A magenta dye-donor element was prepared by coating the following layers in the order recited on a 6 μm poly(ethylene terephthalate) support.

(1) dye-barrier layer of gelatin nitrate (gelatin, cellulose nitrate, and salicylic acid in approximately 20:5:2 weight ratio in a solvent of acetone, methanol and water) (0.11 g/m$^2$), and (2) dye layer containing the following magenta dye (0.17 g/m$^2$), 11 mg/m$^2$ 3M FC-431 ® surfactant, duPont DLX-6000 ® poly(tetrafluoroethylene) micropowder (16 mg/m$^2$) and cellulose acetate propionate (2.5% acetyl, 45% propionyl) (0.37 g/m$^2$) coated from a butanone and cyclopentanone solvent mixture.

On the back side of the element was coated a slipping layer of the type disclosed in copending U.S. patent application Ser. No. 813,199 of Vanier et al., filed Dec. 24, 1985.

Magenta Dye

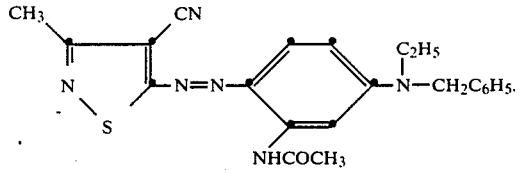

Dye-receiving elements were prepared by coating the polycarbonates as listed in Table 1 (2.9 g/m$^2$) and 41 mg/m$^2$ of 3M FC-431 ® surfactant from a dichloromethane/trichloroethylene solvent mixture on an ICI Melinex 990 ® "white polyester" support.

A second set of dye-receiving elements was prepared as above except that it contained 0.29 g/m$^2$ di-n-butyl phthalate as a plasticizer.

The dye side of each dye-donor element strip 1.25 inches (30 mm) wide was placed in contact with the dye image-receiving layer of the dye-receiver element of the same width. The assemblage was fastened in the jaws of a stepper motor driven pulling device. The assemblage was laid on top of a 0.55 (14 mm) diameter rubber roller and a TDK Thermal Head (No. L-133) and was pressed with a spring at a force of 8.0 pounds (3.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were pulse heated at approximately 8 msec to generate a maximum density image. The voltage supplied to the print head was approximately 22 v representing approximately 1.5 watts/dot (12 mjoules/dot) for maximum power.

The assemblage was separated and the Status A reflection maximum density was read.

Surface deformation was measured using a Gould Microtopographer. Three dimensional topographic representations of the maximum density image surfaces were generated by driving a 0.0001 inch radius diamond stylus at a 45 degree angle relative to the print head direction. The data was analyzed by a Hewlett-Packard computer program to give an average surface roughness in microinches of projection. The following results were obtained:

TABLE 1

| Polycarbonate | Plasticizer | Average Surface Roughness (μ in) | Status A Green $D_{max}$ |
|---|---|---|---|
| A (Control) | No | 1.44 ± 0.10 | 2.8 |
| B | No | 1.32 ± 0.08 | 2.7 |
| C | No | 1.11 ± 0.06 | 2.8 |
| A (Control) | Yes | 1.85 ± 0.25 | 2.9 |
| B | Yes | 1.40 ± 0.18 | 2.8 |
| C | Yes | 1.38 ± 0.14 | 3.0 |

Polycarbonates:

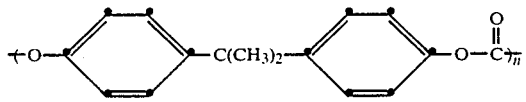

Polycarbonate A was Scientific Polymer Products Inc., Catalog #035 (number average molecular weight approximately 24,000), n calc. approximately 95. Polycarbonate B was General Electric Lexan ® Polycarbonate Resin #ML-4735 (number average molecular weight approximately 36,000), n calc. approximately 140. Polycarbonate C was Bayer AG Makrolon #5705 ® (number average molecular weight approximately 58,000), n calc. approximately 230.

The above data indicate that the three polycarbonate receivers all gave equivalent maximum densities. However, the surface roughness decreases significantly (less deformation) as the polycarbonates of the invention were used which had a higher molecular weight. The same relationship was also observed with the plasticized samples. Thus, a polycarbonate having a number average molecular weight above about 25,000 is necessary in order to minimize surface deformations.

The invention has been described in detail with particular reference to preferred embodiments thereof, but it will be understood that variations and modifications can be effected within the spirit and scope of the invention.

What is claimed is:

1. In a dye-receiving element for thermal dye transfer comprising a support having thereon a polycarbonate dye image-receiving layer, the improvement wherein said polycarbonate has a number average molecular weight of at least about 25,000.

2. The element of claim 1 wherein said polycarbonate is a bisphenol A polycarbonate.

3. The element of claim 2 wherein said bisphenol A polycarbonate comprises recurring units having the formula

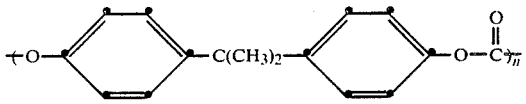

wherein n is from about 100 to about 500.

4. The element of claim 1 wherein said support is poly(ethylene terephthalate) having a white pigment incorporated therein.

5. In a process of forming a dye transfer image comprising imagewise-heating a dye-donor element comprising a support having thereon a dye layer and transferring a dye image to a dye-receiving element to form said dye transfer image, said dye-receiving element comprising a support having thereon a polycarbonate dye image-receiving layer, the improvement wherein said polycarbonate has a number average molecular weight of at least about 25,000.

6. The process of claim 5 wherein said polycarbonate is a bisphenol A polycarbonate.

7. The process of claim 6 wherein said bisphenol A polycarbonate comprises recurring units having the formula

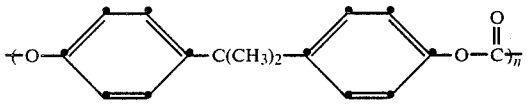

wherein n is from about 100 to about 500.

8. The process of claim 5 wherein said support of said dye-receiving element is poly(ethylene terephthalate) having a white pigment incorporated therein.

9. The process of claim 5 wherein said support for the dye-honor element comprises poly(ethylene terephthalate) which is coated with sequential repeating areas of cyan, magenta and yellow dye, and said process steps are sequentially performed for each color to obtain a three-color dye transfer image.

10. In a thermal dye transfer assemblage comprising:

(a) a dye-donor element comprising a support having thereon a dye layer, and (b) a dye-receiving element comprising a support having thereon a polycarbonate dye image-receiving layer, said dye-receiving element being in a superposed relationship with said dye-donor element so that said dye layer is in contact with said dye image-receiving layer, the improvement wherein said polycarbonate has a number average molecular weight of at least about 25,000.

11. The assemblage of claim 10 wherein said polycarbonate is a bisphenol A polycarbonate.

12. The assemblage of claim 11 wherein said bisphenol A polycarbonate comprises recurring units having the formula

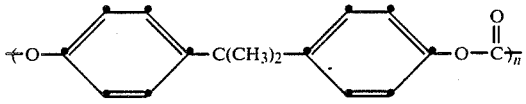

wherein n is from about 100 to about 500.

13. The assemblage of claim 10 wherein said support of said dye-receiving element is poly(ethylene terephthalate) having a white pigment incorporated therein.

* * * * *